United States Patent [19]

Moore

[11] Patent Number: 4,970,551

[45] Date of Patent: Nov. 13, 1990

[54] CARTRIDGE CONTAINING A RECIPROCATING PHOTOCONDUCTOR RIBBON FOR SERIAL ELECTROPHOTOGRAPHIC PRINTING

[75] Inventor: Ronald C. Moore, Sunnyvale, Calif.

[73] Assignee: International Business Machines Corporation, Armonk, N.Y.

[21] Appl. No.: 245,870

[22] Filed: Sep. 16, 1988

[51] Int. Cl.[5] ..... G03G 5/00; G03G 21/00

[52] U.S. Cl. ..... 355/212; 355/299

[58] Field of Search ..... 355/212, 213, 299, 211

[56] References Cited

U.S. PATENT DOCUMENTS

| | | | |
|---|---|---|---|
| 3,807,854 | 4/1974 | Tanaka et al. | 355/212 |
| 3,827,801 | 8/1974 | Tanaka et al. | 355/212 X |
| 3,843,252 | 10/1974 | Tanaka et al. | 355/212 |
| 3,861,613 | 1/1975 | Tanaka et al. | 355/212 X |
| 4,481,275 | 11/1984 | Iseki et al. | 355/299 X |
| 4,490,033 | 12/1984 | Gage et al. | 355/212 |
| 4,511,268 | 4/1985 | Marshall | 400/119 |
| 4,569,581 | 2/1986 | Sato | 355/212 |
| 4,592,644 | 6/1986 | Koizumi | 355/212 |
| 4,639,749 | 1/1987 | Ito | 346/153.1 |

OTHER PUBLICATIONS

Lahr et al., "Line Printer", Xerox Disclosure Journal, vol. 4, #3, May/Jun. 1979, pp. 371-372.

*Primary Examiner*—Fred L. Braun

*Attorney, Agent, or Firm*—Joseph G. Walsh

[57] ABSTRACT

A cartridge for electrophotographic printing which contains a reciprocating photoconductor ribbon, a charging station, a developer station, a transfer station and a retractable cleaner blade. In operation, the photoconductor ribbon is directed past the charging station, through the developer station, and through the transfer station. The cleaner blade is moved into contact with the photoconductor ribbon.

3 Claims, 1 Drawing Sheet

CARTRIDGE CONTAINING A RECIPROCATING PHOTOCONDUCTOR RIBBON FOR SERIAL ELECTROPHOTOGRAPHIC PRINTING

DESCRIPTION

TECHNICAL FIELD

The present invention is concerned with a cartridge useful for electrophotographic printing. It is characterized by containing a reciprocating photoconductor ribbon and is particularly useful in serial electrophotographic printing.

BACKGROUND OF THE ART

The art shows various types of cartridges for electrophotographic printing. Examples of such prior art include U.S. Pat. Nos. 4,511,268 and 4,639,749 and also Xerox Disclosure Journal, Vol. 4, No. 3, 5/6 1979, pp. 371–372. These references, however, differ from the present invention in both structure and function and, in particular, they differ in not disclosing a reciprocating photoconductor ribbon.

DISCLOSURE OF THE INVENTION

The present invention is a cartridge for serial electrophotographic printing. It can be used with conventional paper paths. It can also be used with a conventional full length transfer corona. The invention is plugged into an electrophotographic printer. It can conveniently be used in conjunction with another cartridge containing a toner supply.

The cartridge of the present invention comprises a source of photoconductor ribbon, a charging stage to charge said ribbon, a development station for developing toner image on said ribbon, a transfer station for transferring said toner image to a print medium (such as paper), means for returning a portion of the photoconductor ribbon to said cartridge, a retractable cleaner blade, and means for moving said cleaner blade into contact with said photoconductor ribbon. The printhead and the self-focussing optical array required for the electrophotographic process are outside of the cartridge. The charge corona can be outside the cartridge or, if so desired, can be incorporated in the cartridge of the present invention.

DESCRIPTION OF THE DRAWING

An understanding of the present invention will be facilitated by reference to the accompanying drawing. In FIG. 1, 1 is a source of photoconductor ribbon, for example, a cartridge spool, which is most preferably spring-loaded; 2 is the photoconductor ribbon itself; 3 is the charge corona, which can be outside the cartridge or, when so desired, inside the cartridge as a part thereof; 4 is a charging station drum, in functional proximity to the charge corona. The printhead and self-focussing optical array is represented by 5; this is not part of the cartridge of the present invention, but rather is used in conjunction therewith; 6 is a developer stage and 7 a transfer drum. The top of the drawing shows a transfer corona 10 which is outside the cartridge of the present invention; 8 represents a take-up spool which is also outside of the cartridge, and preferably attached to the side of the printer.

Figure 1:
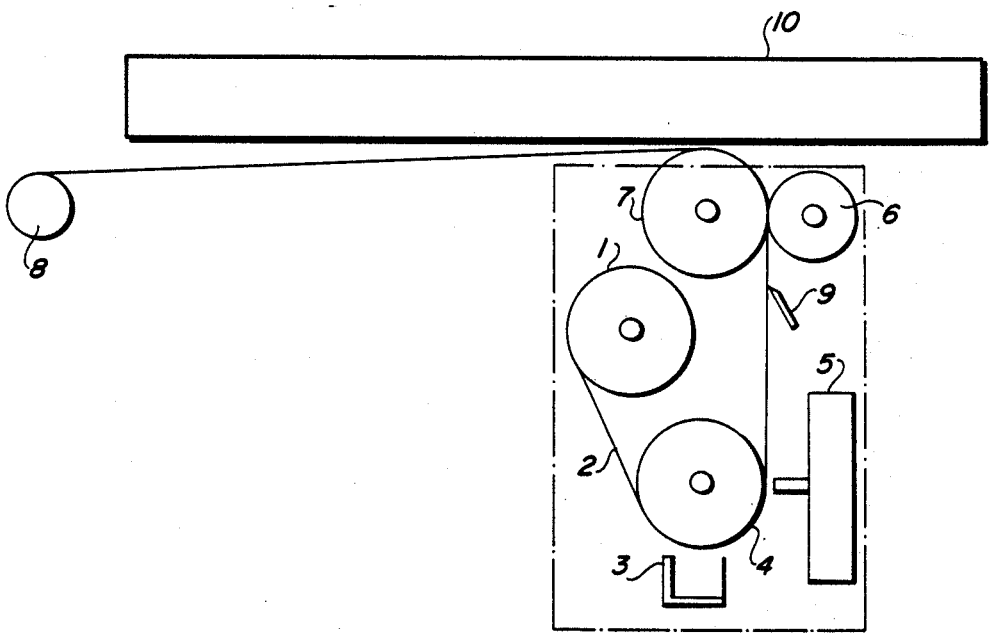
FIG. 1 is a plane view, not to scale, showing the cartridge of the present invention residing inside the dashed box.

As may be seen from inspection of the drawing, the photoconductor ribbon is directed on a path past the charging station and past a location at which the photoconductor ribbon can be image wise exposed. The ribbon is then directed through a developer stage and a transfer stage to transfer the toner image to a print medium. The charge spool 1 is preferably spring-loaded and serves as a means for returning a portion of the photoconductor ribbon. The retractable cleaner blade 9 is provided with means for moving the blade into contact with the photoconductor ribbon while the photoconductor is being returned. This serves to clean the photoconductor ribbon in preparation for producing a further print image.

In usage, the photoconductor ribbon is attached to a take-up spool 8 which is affixed to the side of the printer. The electrophotographic stage rides on a carriage that translates from side-to-side. As the electrophotographic stage moves away from the take-up spool, it transfers the image to the paper. When it moves toward the take-up spool, it indexes out to open up the transfer nip, and rewinds the photoconductor ribbon onto the carriage spool 1. It must be particularly pointed out and emphasized that because of the reciprocating action of the photoconductor ribbon, a retractable scraper blade 9 can be used to clean the photoconductor ribbon in close proximity to the developer drum. This ensures 100% use of the toner and provides a greatly increased life to the toner cartridge. Still an additional advantage of the present invention is that the incorporation of the spooled photoconductor ribbon in the cartridge makes it possible to reel out the photoconductor ribbon from the carriage spool to the take-up spool, thereby extending the useful life of the cartridge by a factor of 5 or more.

It is still an additional advantage of the present invention that the location of the take-up spool outside the cartridge means that the cartridge can be made smaller than has previously been possible. The present invention greatly reduces the cost of the electrophotographic printer and also the cost per printed page.

I claim:

1. A cartridge for electrophotographic printing comprising:

a source of photoconductor ribbon;

a charging station to charge said ribbon;

a developer station for developing a toner image on said photoconductor ribbon;

a transfer station for transferring said toner image to a print medium;

said photoconductor ribbon being directed in a path past said charging station in a path past a location at which the photoconductor ribbon can be image wise exposed, said photoconductor ribbon being directed through said developer station and said transfer station to transfer said toner image to a print medium;

said photoconductor ribbon being attachable to a takeup spool external to the cartridge;

means for returning a portion of said photoconductor ribbon to said cartridge;

a retractable cleaner blade; and means for moving said cleaner blade into contact with said photoconductor ribbon while said photoconductor ribbon is returned to clean said photoconductor ribbon in preparation for producing a further print image.

2. A cartridge as claimed in claim 1 which also contains a charge corona in functional proximity to the charging station.

3. A cartridge as claimed in claim 1 wherein the means for returning a portion of the photoconductor ribbon to said cartridge is a spring-loaded spool.

* * * * *